United States Patent [19]

Kreisel

[11] 4,134,819

[45] Jan. 16, 1979

[54] ARRANGEMENT FOR CONTROLLING THE ELECTRIC ENERGY SUPPLY TO AN ELECTROPLATING INSTALLATION

[75] Inventor: Rudolf Kreisel, Nuremberg, Fed. Rep. of Germany

[73] Assignee: Schering AG, Berlin and Bergkamen, Fed. Rep. of Germany

[21] Appl. No.: 885,568

[22] Filed: Mar. 13, 1978

[30] Foreign Application Priority Data

Mar. 14, 1977 [DE] Fed. Rep. of Germany ..... 2711537

[51] Int. Cl.[2] ..... C25D 17/04; C25C 7/00

[52] U.S. Cl. ..... 204/228; 204/279; 204/297 R

[58] Field of Search ..... 204/228, 279, 297 R, 204/225

[56] References Cited

U.S. PATENT DOCUMENTS

| | | | |
|---|---|---|---|
| 2,070,343 | 2/1937 | Turnock | 204/297 R X |
| 2,457,510 | 12/1948 | Van Ornum | 205/225 X |
| 3,417,008 | 12/1968 | Koltuniak | 204/225 |
| 3,632,499 | 1/1972 | Chessin | 204/228 X |

FOREIGN PATENT DOCUMENTS

| | | | |
|---|---|---|---|
| 39149 | 9/1931 | France | 204/228 |

*Primary Examiner*—John H. Mack
*Assistant Examiner*—D. R. Valentine
*Attorney, Agent, or Firm*—Michael J. Striker

[57] ABSTRACT

An arrangement for controlling the electric energy supply rate to an electroplating installation includes a positionally adjustable actuating member connected to a carrier which supports workpieces to be electroplated in an electroplating vat, and a sensor mounted on the vat and operative for detecting the extent of positional adjustment of the actuating member and generating a signal proportionate thereto. The signal is then transmitted to a source of direct electric current to be used thereat for controlling the output rate of the source. The actuating member is a setting screw which is threaded into a sleeve which, in turn, is mounted on a bracket rigidly connected to the carrier, while the sensor includes a housing rigidly mounted on a lug of the vat, and a potentiometer accommodated in the housing and having a detecting rod which extends beyond the housing and into the path of displacement of the setting screw. The housing is sealingly closed by a sealing cable connector, on the one hand, and by a bellows-shaped protective member sealingly connected to the housing and surrounding the detecting rod of the potentiometer, on the other hand. A spring urges the detecting rod toward its extended position relative to the housing. A cable passes through the cable connector and transmits the signals generated in the potentiometer in dependence on the extent of displacement of the detecting rod to the source to control the same.

15 Claims, 2 Drawing Figures

ARRANGEMENT FOR CONTROLLING THE ELECTRIC ENERGY SUPPLY TO AN ELECTROPLATING INSTALLATION

BACKGROUND OF THE INVENTION

The present invention relates to an arrangement for controlling the rate at which a source supplies electric energy into a circuit, in general, and more particularly to such an arrangement which is used in an electroplating installation to control the rate of the electroplating operation which is being performed therein.

Electroplating installations per se are already known and are being widely used in various fields of human endeavor to improve either the mechanical or chemical properties, or the appearance, of a wide variety of objects, articles or workpieces. Basically, an electroplating installation includes at least one electroplating vat which accommodates an electroplating bath and is equipped with electrodes, and a carrier on which the workpiece or a plurality of workpieces is supported for the duration of the electroplating operation. In many instances, the carrier is removably mounted or supported on the electroplating vate so that the workpieces can be introduced into and removed from the electroplating bath together with the carrier which supports the same. Under these circumstances, it is very advantageous, in order to facilitate the handling of the carrier, if the latter is only supported on the electroplating vat by means of pins or the like which are introduced from above into the associated and cooperating support arrangements provided on the electroplating vat. The present invention is intended to be employed in an electroplating installation of this type.

The operation of an electroplating installation is also too well known to require any protracted discussion here. Suffice it to say that a source of direct electric current is employed which supplies electric energy into an electric circuit of the electroplating installation which includes the above-mentioned electrodes and, more often than not, also the carrier for the workpieces. In other words, usually the electric current flows through the carrier, rather than only passing through the workpieces and bypassing the carrier. When electric current flows in the above-mentioned circuit, metal is being deposited on the workpieces at a rate which is determined by the voltage or the intensity of the direct electric current supplied to the electroplating installation by the electric source. It is also well known that the proper control of the above-mentioned parameters of the electric current is determinative of the quality of the metallic layer deposited on the workpieces during the electroplating operation. The above-mentioned parameters of the electric current must not be too high for the respective workpieces to be electroplated inasmuch as the deposited metallic layer would otherwise be faulty; on the other hand, these parameters should also be as high as possible in order to achieve that the electroplating operation is performed in a feasibly short period of time.

When workpieces of always the same type and thus of always the same surface area are being treated in the electroplating installation or in the particular electroplating vat all the time, the control of the above-mentioned parameters can be achieved, for instance, manually only once and the adjusted magnitude of these parameters may then remain unchanged. However, very often different types of workpieces are to be treated after each other in the electroplating installation so that frequent control of the intensity or of the voltage of the direct electric current so as to take into account the properties of the respective workpieces to be electroplated in the electroplating installation, is unavoidable. When this is done manually by the operating personnel, this is very time-consuming and hence expensive.

In order to save this expense, it has been already proposed to provide variable markings on the carrier for the workpieces to be electroplated. In the event that the workpiece carrier is to be transported into the electroplating installation, the above-mentioned markings are adjusted at the location at which the workpieces are introduced thereinto to correspond to the properties of the workpieces to be electroplated. This pre-set marking is then transmitted, at the respective electroplating station or vat, for instance, to terminal switches or to non-contact switching devices. Then, a control device of the source, such as of a rectifier, has a certain value of electric voltage or electric current associated with each of the adjusted positions of the markings on the workpiece carrier. Then, the rectifier which is equipped with an electric setting drive, is automatically set to the above-mentioned value.

However, experience with the above-discussed arrangements of this type which are equipped with a pre-selection of the setting of the rectifier on the workpiece carrier, has shown that they are possessed of a very important disadvantage which resides in the fact that the setting of the rectifier output is possible only on a step-by-step basis. Furthermore, the required voltage or intensity value has to be first associated with one of the above-mentioned steps, which renders it possible that such an association could be erroneous. Also, as the demand for a possibly closest approximation of the pre-selected value to the optimum value for treating the respective workpieces is increasing, the number of the different adjusting possibilities also considerably increases which renders the operation of this arrangement increasingly difficult.

SUMMARY OF THE INVENTION

Accordingly, it is a general object of the present invention to avoid the above-mentioned disadvantages.

More particularly, it is an object of the present invention to develop an arrangement for controlling the electric energy supply rate to an electroplating installation which is not possessed of the above-mentioned disadvantages.

A further object of the present invention is to so design the arrangement of the type here under consideration as to permit a stepless control of the magnitude of the voltage or intensity of the direct electric current which is supplied to the workpiece carrier of the electroplating installation.

A concomitant object of the present invention is to develop an arrangement of the above-mentioned type which is simple in construction, inexpensive to manufacture, install and operate, durable, and reliable nevertheless.

In pursuance of these objects and others which will become apparent hereafter, one feature of the present invention resides, briefly stated, in an arrangement for controlling the rate at which a source supplies electric energy into a circuit that includes a carrier which is displaceable into and out of an operative position in which it supports workpieces to be electroplated in an electroplating vat, which comprises an actuating member connected to the carrier for displacement therewith and for positional adjustment relative thereto; means on the vat for detecting, in the operative position of the carrier, the extent of positional adjustment of the actuating member and for generating a signal proportionate to the detected extent; and means for transmitting the signal to the source to control the same.

The arrangement of the present invention further comprises means for connecting the actuating member to the carrier, including an externally threaded sleeve and at one nut externally threaded onto the sleeve. Advantageously, the connecting means further includes a connecting bracket which is attached to the carrier. Then, the above-mentioned nut contacts the bracket to connect the sleeve to the latter. It is further advantageous when the connecting means further includes an additional nut externally threaded onto the sleeve across the bracket from the above-mentioned nut and, together with the latter, clampingly connecting the sleeve to the bracket.

According to a currently preferred aspect of the present invention, the sleeve is also internally threaded and the actuating member is a setting screw which is internally threaded to the sleeve. At least one arresting nut is threaded onto the setting screw and engages the sleeve to arrest the setting screw in a selected adjusted position thereof relative to the sleeve. Advantageously, the setting screw has a disk-shaped actuating portion.

It is further preferred for the sleeve to have an inspection opening and a setting scale at the latter, and for the setting screw to be provided with an indicating marking which appears in the inspection opening to indicate the extent of positional adjustment of the setting screw on the setting scale.

According to a further advantageous concept of the present invention, the detecting means includes a housing mounted on the vat and a detecting rod movably supported in the housing and extending into the path of displacement of the setting screw as the carrier approaches the operative position thereof for the setting screw to move the detecting rod relative to the housing proportionately to the extent of positional adjustment thereof. Then, it is advantageous for the setting screw and the detecting rod to be coaxial in the operative position of the carrier.

It is further advantageous when the generating means includes a potentiometer which changes resistivity in dependence on the movement of the detecting rod relative to the housing. It is also advantageous when the detecting means further includes a spring which urges the detecting rod toward an extended position thereof relative to the housing in which the detecting rod projects to the greatest extent into the path of displacement of the actuating member.

It is further proposed by the present invention that the transmitting means include a cable. Then, there may be provided means for sealing the housing which includes a sealed cable connection through which the above-mentioned cable passes from the interior to the exterior of the housing, and a bellows-shaped protective member which is sealingly connected to the housing and surrounds that portion of the detecting rod which extends outwardly of the housing into the above-mentioned path. Advantageously, there is provided means for mounting the housing on the vat which includes a mounting lug rigid with the vat, an external thread on the housing, and at least one mounting nut which is externally threaded onto the housing and engages the mounting lug to connect the housing thereto. However, it is even more advantageous when the mounting means further includes another mounting nut which is located across the mounting lug from the one mounting nut and clampingly engages the mounting lug with the latter.

When the arrangement of the present invention is constructed in the above-mentioned manner, it is not only very simple to manufacture and to set up, but it is also advantageous with respect to its function. Thus, when the adjustment member which is mounted on the workpiece carrier, is displaced together with the latter toward the operative position relative to the electroplating vat, it actuates the detecting and generating means, preferably a potentiometer or an inductive transducer, which is rigidly mounted on the electroplating vat. Then, the resistivity of the potentiometer after the introduction of the workpiece carrier serves as a signal which is used for the regulation or setting of the rectifier to control the voltage or the current which the rectifier supplies to the respective electroplating installation, in proportion to the resistance of the potentiometer.

Thus, the resistance of the potentiometer or a similar transducer can be changed by a simple adjustment of the actuating member which is mounted on the workpiece carrier; as a result of this, the electric energy supply rate of the rectifier can be unproblematically varied. In view of the fact that the actuating member can be steplessly adjustable as to its position, there is obtained a technically simple pre-selection of the rectifier voltage or of the electroplating current.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENT

Figure 1:
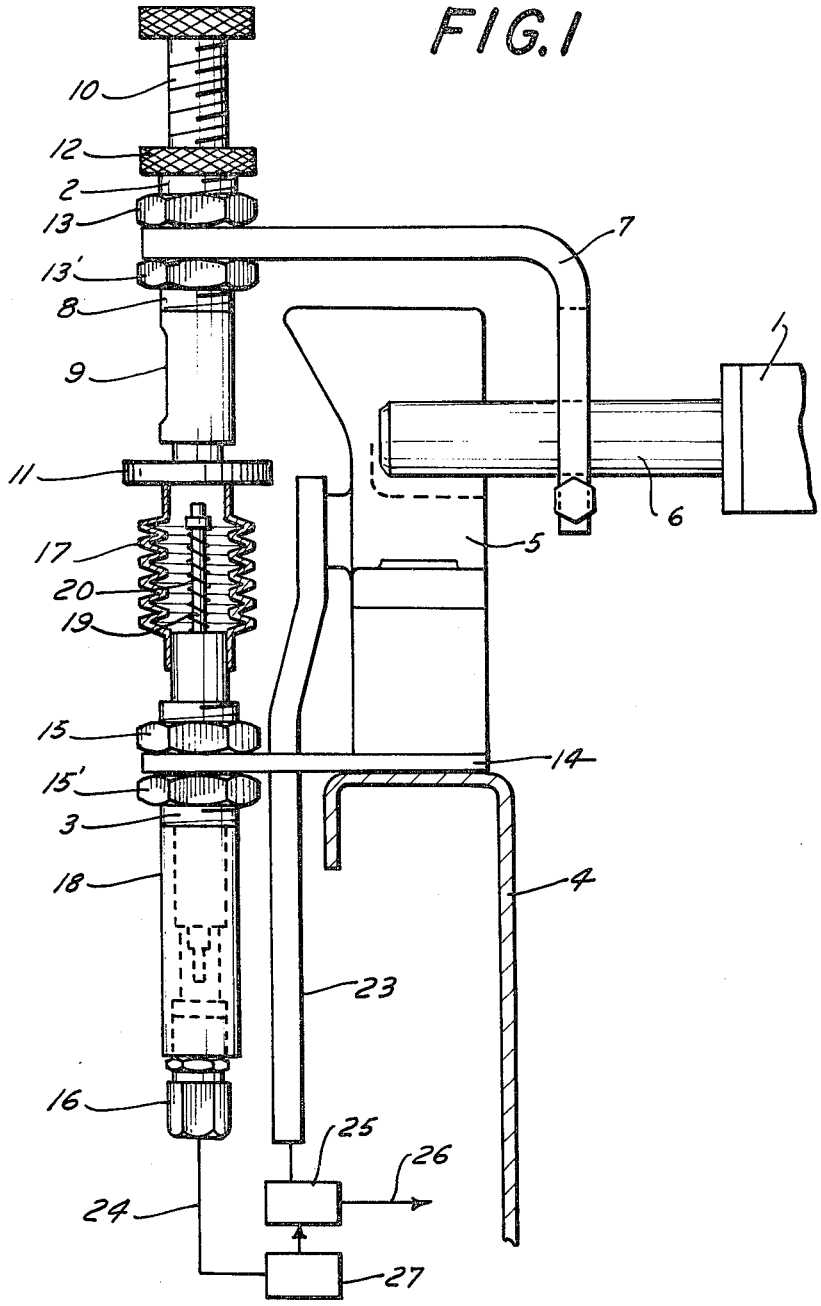
FIG. 1 is a partially cross sectioned side elevational view of the arrangement of the present invention as mounted on a fragmentarily illustrated electroplating installation.

Referring now to the drawings in detail and first to FIG. 1 thereof, it may be seen that the reference numeral 1 has been used to designate a workpiece carrier which, in a known manner, supports workpieces to be electroplated in an electroplating vat 4. The workpiece carrier 1 has a pin or a similar projection 6 which is supported on a support 5 which is rigidly connected to the electroplating vat 4.

The arrangement of the present invention which is used in this environment includes an actuating element 2 which is mounted on the workpiece carrier 1, and a transducer or a similar signal-generating element 3. The workpieces which are to be electroplated are supported on the workpiece carrier 1 in a conventional manner and are electrically connected to the negative terminal of a diagrammatically illustrated source of electric energy, such as a rectifier 25. The electric connection is established via a cable 23 or a similar lead, the support 5, the projection 6 and the remainder of the workpiece carrier 1. The positive terminal for the rectifier 25 is connected, in a known manner, such as by a lead 26, with conventional and hence not illustrated electrodes which are rigidly attached to the lateral walls of the electroplating vat 4.

A bracket 7 is mounted, as illustrated, by a threaded connection, on the projection 6 of the workpiece carrier 1 and the actuating element 2 is connected thereto. The actuating element 2 includes a threaded sleeve 8 having an inspection opening 9, an actuating member 10 illustrated as a setting screw having a disk-shaped actuating portion 11, an arresting nut 12 which is threaded on the setting screw 10 and two connecting nuts 13, 13' which are also externally threaded onto the sleeve 8 and clamp the bracket 7 between themselves.

The signal-generating element 3 is mounted on the electroplating vat 4 of the electroplating installation by means of a connecting lug 14. The signal-generating element 3 is externally threaded and two connecting nuts 15, 15' connect the signal-generating element 3 to the connecting lug 14. As a result of the cooperation of the two connecting nuts 15, 15' with the signal-generating element 3 and with the connecting lug 14, it is possible to adjust the vertical position of the signal-generating element 3 relative to the connecting lug 14.

The signal-generating element is sealed, at its lower end, by a sealed cable connection 16, and at its upper end by a bellows-shaped protective member 17. Thus, a potentiometer 18 or a similar signal-generating device which is accommodated in the signal-generating element 3 is protected from any influence of the aggressive atmosphere which exists in and around the electroplating vessel 4. A cable 24 connects the signal-generating device 18 to a diagrammatically illustrated control 27 for the diagrammatically illustrated source 25. Thus, for instance, when the device 18 is a potentiometer, the resistance thereof will determine the magnitude of the signal which is transmitted from the device 18 to the control 27 through the cable 24. Thus, when the carrier 1 and especially the projection 6 thereof is properly positioned relative to the electroplating vat 4 and the support 5 thereof, the electric resistance of the device 18 will change in a manner still to be described and thus the control 27 will control the source 25 in the desired manner. The control 27 evaluates, in a fully conventional manner, the signal fed into it by the cable 24 and utilizes this evaluation, also in a fully conventional manner, for controlling the source 25.

The signal-generating device 18 of the signal-generating element 3 is equipped with a detecting rod 19 which is pressed by a spring 20 upwardly as illustrated in the drawing. Now, when the disk-shaped actuating portion 11 presses the detecting rod 19 downwardly, against the force of the spring 20, the resistance of the potentiometer or a similar device 18 changes. Thus, when the workpiece carrier 1 is introduced into the electroplating vat 4 from above, the actuating element 2 presses the detecting rod 19 downwardly. The extent of the downward movement of the detecting rod 19 can be selected by positionally adjusting the setting screw 10. Because of the cooperation of the disk-shaped actuating portion 11 of the setting screw 10 of the actuating element 2 with the detecting rod 19 of the signal-generating element 3 and thus with the signal-generating device 18 thereof, the extent of positional adjustment of the setting screw 10 will translate into a proportional change in the resistance of the device 18 which, in turn, controls the operation of the control 27 which determines the output rate of the rectifier 25 in terms of electric current or electric voltage.

Figure 2:
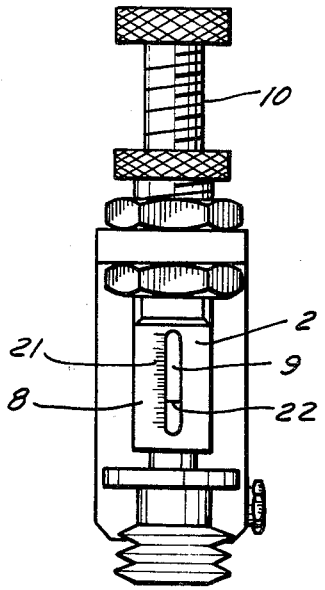
FIG. 2 is a fragmentary front elevational view of the arrangement of FIG. 1 showing additional structural details.

Referring now to FIG. 2 of the drawing, it may be seen therein that the extent of positional adjustment of the setting screw 10 of the actuating element 2 can be determined with reference to a measuring scale 21 which is provided on the sleeve 8 of the actuating element 2 adjacent the inspection opening 9. The setting screw 10, as illustrated, is provided with a marking 22 which indicates the extent of adjustment of the setting screw 10 relative to the measuring scale 21.

It will be understood that each of the elements described above, or two or more together, may also find a useful application in other types of constructions differing from the types described above.

While the invention has been illustrated and described as embodied in an arrangement for controlling the rate at which a source supplies electric energy into a circuit of an electroplating installation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for controlling the rate at which a source supplies electric energy into a circuit that includes a carrier which is displaceable into and out of an operative position in which it supports workpieces to be electroplated in an electroplating vat, comprising an actuating member connected to the carrier for displacement therewith and for positional adjustment relative thereto; means on said vat for detecting, in the operative position of the carrier, the extent of positional adjustment of said actuating member and for generating a signal proportionate to the detected extent; and means for transmitting the signal to the source to control the same.

2. An arrangement as defined in claim 1; and further comprising means for connecting said actuating member to the carrier, including an externally threaded sleeve and at least one nut externally threaded onto said sleeve.

3. An arrangement as defined in claim 2, wherein said connecting means further includes a connecting bracket attached to the carrier; and wherein said nut contacts said bracket to connect said sleeve to the latter.

4. An arrangement as defined in claim 3, wherein said connecting means further includes an additional nut externally threaded onto said sleeve across said bracket from said nut and, together with the latter, clampingly connecting said sleeve to said bracket.

5. An arrangement as defined in claim 2, wherein said sleeve is also internally threaded; wherein said actuating member is a setting screw internally threaded into said sleeve; and further comprising at least one arresting nut threaded onto said setting screw and engaging said sleeve to arrest said setting screw in a selected adjusted position thereof relative to said sleeve.

6. An arrangement as defined in claim 5, wherein said setting screw has a disk-shaped actuating portion.

7. An arrangement as defined in claim 5, wherein said sleeve has at least one inspection opening and a setting scale at the latter.

8. An arrangement as defined in claim 7, wherein said setting screw is provided with an indicating marking which appears in said inspection opening to indicate the extent of positional adjustment of said setting screw on said setting scale.

9. An arrangement as defined in claim 5, wherein said detecting means includes a housing mounted on the vat and a detecting rod movably supported in said housing and extending into the path of displacement of said setting screw as the carrier approaches the operative position thereof for the setting screw to move said detecting rod relative to said housing proportionately to the extent of positional adjustment thereof.

10. An arrangement as defined in claim 9, wherein said setting screw and said detecting rod are coaxial in the operative position of the carrier.

11. An arrangement as defined in claim 9, wherein said generating means includes a potentiometer which changes resistivity in dependence on the movement of said detecting rod relative to said housing.

12. An arrangement as defined in claim 9, wherein said detecting means further includes a spring which urges said detecting rod toward an extended position thereof relative to the housing in which said detecting rod projects to the greatest extent into said path.

13. An arrangement as defined in claim 9, wherein said transmitting means includes a cable; and further comprising means for sealing said housing, including a sealed cable connection through which said cable passes from the interior to the exterior of said housing, and a bellows-shaped protective member which is sealingly connected to said housing and surrounds that portion of said detecting rod which extends outwardly of said housing into said path.

14. An arrangement as defined in claim 9; and further comprising means for mounting said housing on the vat, including a mounting lug rigid with the vat, an external thread on said housing, and at least one mounting nut which is externally threaded onto said housing and engages said mounting lug to connect said housing thereto.

15. An arrangement as defined in claim 14, wherein said mounting means further includes another mounting nut which is located across said mounting lug from said one mounting nut and clampingly engages said mounting lug with the latter.

* * * * *